US006260233B1

(12) United States Patent
Wareham et al.

(10) Patent No.: US 6,260,233 B1
(45) **Date of Patent: *Jul. 17, 2001**

(54) REMOVABLE HOSE AND TOOL CADDY FOR A VACUUM CLEANER

(75) Inventors: Richard A. Wareham; David M. J. Allgeier; Nick M. Bosyj; Arne J. Diehl; Douglass A. King; Keith G. Minton, all of North Canton; John C. Porter, Alliance, all of OH (US)

(73) Assignee: The Hoover Company, North Canton, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/298,777

(22) Filed: Apr. 23, 1999

(51) Int. Cl.[7] ..... A47L 9/00
(52) U.S. Cl. ..... 15/323; 15/351
(58) Field of Search ..... 15/323, 339, 351; D32/31, 32

(56) References Cited

U.S. PATENT DOCUMENTS

| | | | |
|---|---|---|---|
| D. 226,822 | | 5/1973 | Haynes . |
| D. 294,755 | | 3/1988 | Lackner et al. . |
| D. 295,910 | | 5/1988 | Hill . |
| D. 334,260 | * | 3/1993 | Kieft et al. . |
| D. 357,562 | | 4/1995 | Chumley et al. . |

(List continued on next page.)

FOREIGN PATENT DOCUMENTS

| | | |
|---|---|---|
| 529288 | 5/1957 | (BE) . |
| 617564 | 8/1935 | (DE) . |
| 406244 | 11/1933 | (GB) . |
| 637918 | 5/1950 | (GB) . |

OTHER PUBLICATIONS

Photographs of Sorma Commercial Upright Bag Door—Model 23791, Received Apr. 1981.
Photograph of Eureka Bravo II Powerline Plus Upright—Model 7680, Received Apr. 1996.
Photographs of Bissell Powersteamer Extractor—Model 1695, Received 1997.
Photographs and Instruction Manual for Royal VisionMax, Received Mar. 10, 1999.

*Primary Examiner*—Terrence R. Till
(74) *Attorney, Agent, or Firm*—A. Burgess Lowe; Thomas R. Kingsbury

(57) ABSTRACT

A hose and tool caddy removably mounts to an upright vacuum cleaner. The hose and tool caddy stores the vacuum cleaner hose and accessory tools, such as a dusting brush, furniture nozzle, extension wand and crevice tool, which are used for above-the-floor cleaning. When the upright vacuum cleaner is being used for floor care, the hose and tool caddy may be removed from the upright vacuum cleaner and hung-up. The hose and tool caddy includes a base and a guide member. The base is formed with a looped channel for receiving the hose, a pair of resilient C-clamps for supporting the dusting brush and furniture nozzle and a vertically extending channel for receiving the extension wand with the crevice tool stored therein. The upright vacuum cleaner includes a track member for slidably receiving the guide member when the hose and tool caddy is being mounted to the upright vacuum cleaner. The base includes an upwardly extending hook for grasping the hose and tool caddy when the hose and tool caddy is being mounted on or removed from the upright vacuum cleaner. The hook is used to hang the hose and tool caddy on a closet bar, door handle or the like.

39 Claims, 6 Drawing Sheets

U.S. PATENT DOCUMENTS

| | | | | |
|---|---|---|---|---|
| D. 363,163 | | 10/1995 | Funatsu et al. . | |
| D. 391,703 | * | 3/1998 | Miller et al. . | |
| D. 426,358 | * | 6/2000 | Saunders et al. | D32/31 |
| 2,293,859 | | 8/1942 | Scott . | |
| 2,355,034 | | 8/1944 | Scott . | |
| 2,450,172 | | 9/1948 | Stoner . | |
| 2,534,122 | | 12/1950 | Hamala . | |
| 2,537,719 | | 1/1951 | Tuepker . | |
| 2,713,696 | | 7/1955 | Gorham . | |
| 2,801,277 | | 7/1957 | Numsen . | |
| 2,825,087 | | 3/1958 | Meyerhoefer . | |
| 3,771,191 | | 11/1973 | Cain . | |
| 3,872,538 | | 3/1975 | Crouser . | |
| 3,955,237 | | 5/1976 | Chateauneuf et al. . | |
| 4,638,607 | | 1/1987 | Lackner et al. . | |
| 4,653,638 | | 3/1987 | Lackner et al. . | |
| 4,683,607 | | 8/1987 | Lackner et al. | 15/323 |
| 5,071,012 | | 12/1991 | Jailor . | |
| 5,137,156 | | 8/1992 | Riczinger et al. . | |
| 5,233,722 | | 8/1993 | McKnight et al. . | |
| 5,247,719 | | 9/1993 | Wareham et al. . | |
| 5,303,447 | | 4/1994 | McKnight . | |
| 5,313,686 | | 5/1994 | Berfield | 15/323 |
| 5,331,714 | | 7/1994 | Essex et al. . | |
| 5,493,731 | * | 2/1996 | Wood | 15/323 |
| 5,839,709 | | 11/1998 | Leonard . | |
| 6,012,200 | * | 1/2000 | Murphy et al. | 15/352 |
| 6,098,241 | * | 8/2000 | Wood | 15/323 |

* cited by examiner 120
92
84
98
88
96
76
80
90
108
110
114
116
122
100
70
144
146
94
146
82
106
102
118

70
84
94
86
116
122
144
146
146
144
82
114

70
84
100
98
76
96
90
88
110
86
104
116
108
122
92
82
140
142
94
106
102
114

REMOVABLE HOSE AND TOOL CADDY FOR A VACUUM CLEANER

BACKGROUND OF THE INVENTION

1. Technical Field

The invention relates to vacuum cleaners. Particularly, the invention relates to vacuum cleaner hose and tool storage. Even more particularly, the invention relates to a hose and tool caddy which may be easily mounted on or removed from an upright vacuum cleaner.

2. Background Information

It is well known that vacuum cleaners typically fall into one of several categories, including uprights, canisters, and sticks. Upright vacuum cleaners are generally perceived as providing superior floor care. Canister cleaners are generally perceived as providing a certain degree of flexibility in use, accommodating both floor care and above-the-floor cleaning. Stick cleaners are generally perceived as providing for quick cleanup of floor surfaces and the like, and are appreciated for their ease of storage and ready availability.

To increase the popularity of upright cleaners and eliminate the perception that upright cleaners could only be used for floor care, or were difficult to change from floor care to above-the-floor cleaning, valve arrangements, such as that shown in U.S. Pat. No. 5,134,750 assigned to a common assignee, were added to upright cleaners. These valve arrangements allowed upright cleaners to be easily changed between the floor care and above the floor cleaning modes. However, the above-the-floor cleaning mode typically requires an accessory hose and accessory tools, such as a crevice tool, dusting brush, furniture nozzle and extension wand.

The problem with including valve arrangements on upright cleaners then became storage of the hose and accessory tools. Typically, the hose and tools were stored in a closet or drawer and were not readily available when the vacuum cleaner was in use. Thus, on-board hose and tool storage, such as a tool caddy or a tool storage compartment, was developed allowing hoses and accessory tools to be stored directly on upright vacuum cleaners. Examples of on-board hose and tool storage are shown in U.S. Pat. No. 5,137,156, U.S. Pat. No. 5,233,722, U.S. Pat. No. 5,247,719, U.S. Pat. No. 5,303,447 and U.S. Pat. No. 5,331,714, assigned to a common assignee.

Although it is convenient to have the hose and accessory tools mounted directly on upright vacuum cleaners, there may be instances when upright cleaners are only being used in the floor care mode. In such a case, it may be undesirable to include the extra weight of the hose, accessory tools and tool caddy on the cleaner.

Therefore, the need exists for a hose and tool caddy which may be mounted on an upright vacuum cleaner allowing the hose and accessory tools to be easily accessed for above-the-floor cleaning, or which may be easily removed from the upright cleaner when the upright cleaner is only being used for floor care.

SUMMARY OF THE INVENTION

Objectives of the invention include providing an improved hose and tool caddy capable of storing a vacuum cleaner hose and/or vacuum cleaner accessory tools.

A further objective is to provide such a hose and tool caddy which may be mounted on an upright vacuum cleaner providing convenient access to the hose and accessory tools for above-the-floor cleaning.

Another objective is to provide such a hose and tool caddy which may be easily removed from the upright vacuum cleaner when the upright vacuum cleaner is being used only for floor care.

A still further objective is to provide such a hose and tool caddy which may be easily stored when the hose and tool caddy is removed from the upright vacuum cleaner.

A further objective is to provide such a hose and tool caddy which reduces the weight of the upright vacuum cleaner when the hose and tool caddy is removed therefrom.

These and other objectives will be readily apparent from the following description taken in conjunction with the accompanying drawings.

In carrying out the invention in one form thereof, these objectives and advantages are obtained by providing an upright vacuum cleaner having a housing, and a removable caddy which may be mounted on and removed from the upright vacuum cleaner for storing vacuum cleaner accessories, said removable caddy including a base which removably mounts to the upright vacuum cleaner; a connector on the base for removably mounting the base on the upright vacuum cleaner; and an accessory retainer formed on the base for storing the vacuum cleaner accessories.

BRIEF DESCRIPTION OF DRAWINGS

The preferred embodiment of the invention, illustrative of the best mode in which applicants have contemplated applying the principles is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
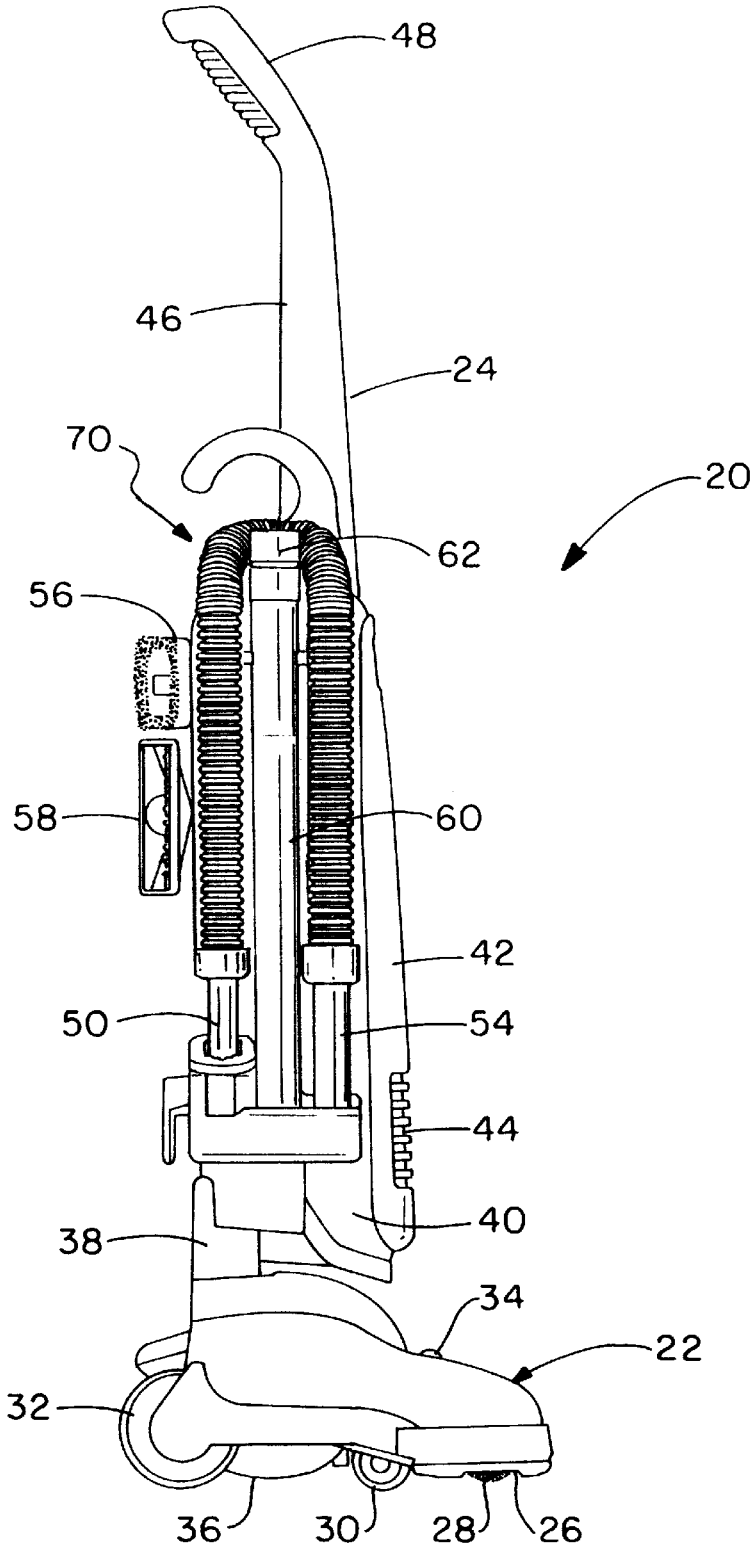
FIG. 1 is a right side elevational view showing an upright vacuum cleaner and removable hose and tool caddy attached thereto.

An upright vacuum cleaner is shown in FIG. 1 and is indicated generally at 20. Upright vacuum cleaner 20 includes a foot 22 and an upper housing assembly 24 pivotally connected to foot 22. Foot 22 is similar to those known in the art and includes a nozzle opening 26 for receiving a stream of dirt-laden air and an agitator 28 for agitating and loosening dust and debris from a floor surface when upright vacuum cleaner 20 is in the floorcare mode. Foot 22 further includes a pair of front wheels 30 rotatably mounted on a wheel carriage (not shown), and a pair of rear wheels 32. A height-adjustment knob 34 is positioned on foot 22 for adjusting the height of the nozzle opening 26 relative to the floor surface.

Foot 22 is formed with a curved bottom surface 36 which receives a motor-fan housing (not shown). The motor-fan housing houses a motor-fan assembly (not shown) which creates the suction necessary to remove the loosened dust and debris from the floor surface. The motor-fan assembly attaches to the upper housing assembly 24 by a dirt duct 38. The upper housing assembly 24 houses a vacuum cleaner filter bag (not shown) for receiving and filtering the dirt-laden air stream which is created by the motor-fan assembly and which is conveyed to the filter bag through dirt duct 38.

Upper housing assembly 24 includes a rear housing 40 which forms the filter cavity for receiving the filter bag, a door 42 which encloses the cavity and which is formed with a plurality of exhaust slots 44, and an upper handle 46 which extends upwardly from rear housing 40 and which is formed with a rearwardly angled hand grip 48. The upright vacuum cleaner 20 may be used in either a floor care mode whereby the suction from the motor-fan assembly is directed to nozzle opening 26, or an above-the-floor cleaning mode whereby the suction is directed to an accessory tool opening (not shown). The accessory tool opening receives a proximate end 50 of an accessory hose 52. Hose 52 includes a distal end 54 which receives the tubular end of one of a plurality of accessory tools for use in above-the-floor cleaning. The accessory tools are shown in FIG. 1 and include a dusting brush 56, a furniture nozzle 58, an extension wand 60 and a crevice tool 62 stored within wand 60. Dusting brush 56 and furniture nozzle 58 include a tapered tubular end for insertion within either distal end 54 of hose 52 or wand 60.

Figure 6:
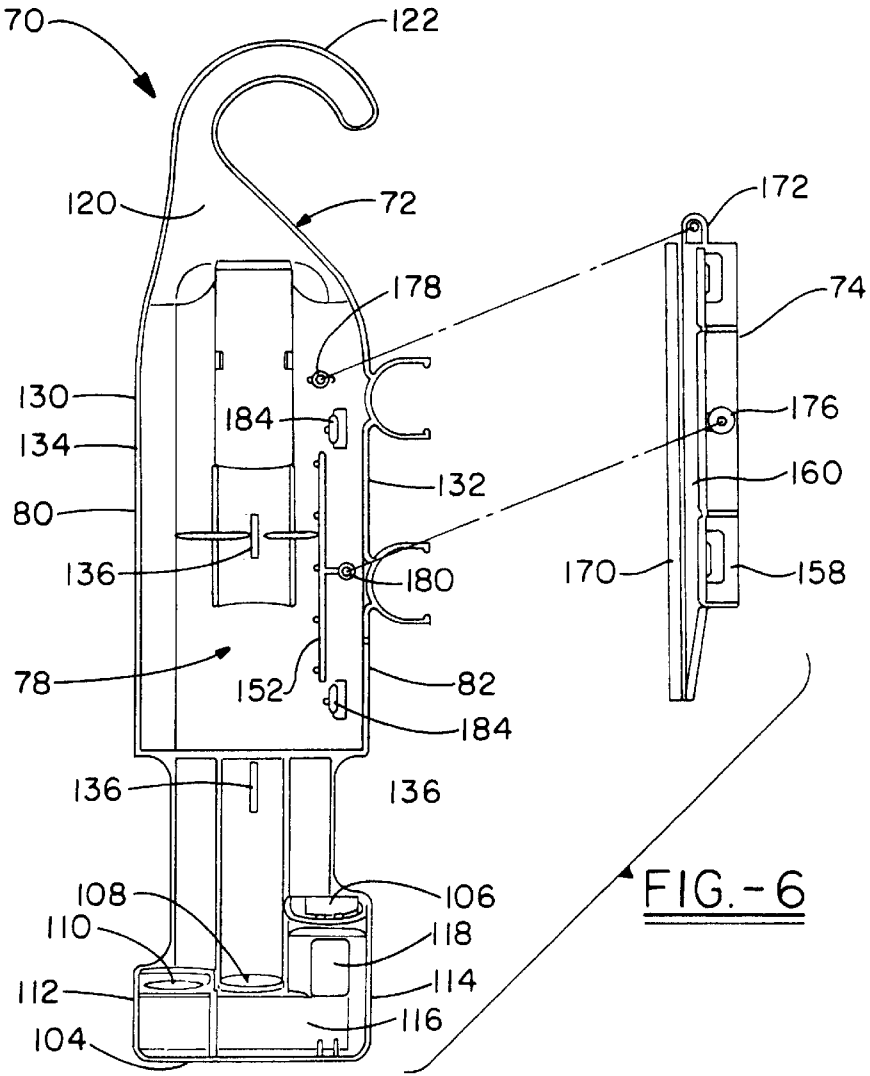
FIG. 6 is a left side elevational view of the hose and tool caddy of FIG. 5 showing a guide member exploded therefrom.
Figure 5:
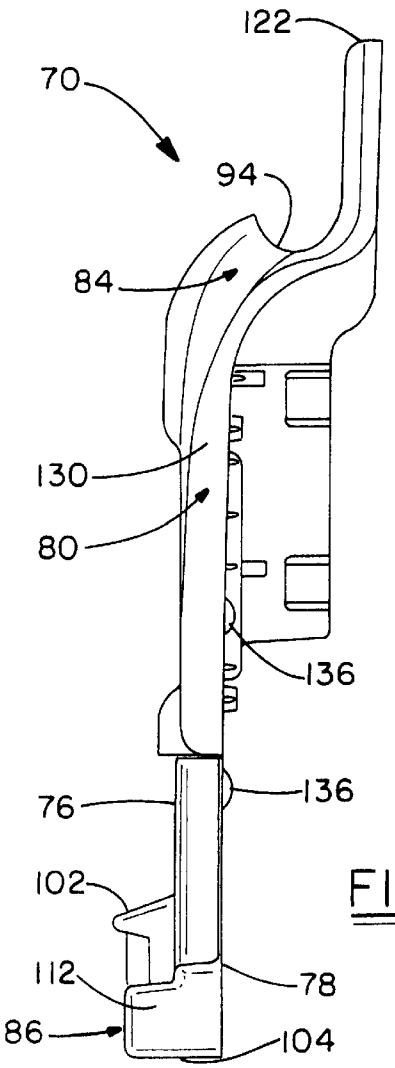
FIG. 5 is a front elevational view of the hose and tool caddy of FIG. 4.

In the illustrated preferred form of the present invention, the hose 52 and the accessory tools 56, 58, 60 and 62 are stored on a hose and tool caddy 70. Hose and tool caddy 70 is shown in detail in FIGS. 2–6 and generally includes a base 72 and a guide member 74 (FIG. 6) which removably mounts hose and tool caddy 70 on the upright vacuum cleaner 20.

With the point of reference being behind vacuum cleaner 20, base 72 includes a right side or outer surface 76 (FIGS. 2 and 4), a left side or inner surface 78 (FIGS. 5 and 6), a front 80 (FIG. 5), a rear 82 (FIG. 3), an inwardly curved top 84 (FIGS. 2–5) and an outwardly extending bottom shelf 86. Outer surface 76 of base 72 is formed with a looped channel 88 (FIGS. 2 and 4) for receiving hose 52 in a looped configuration. Looped channel 88 is generally U-shaped in cross-section and includes a vertical front section 90 which extends adjacent to front 80 of base 72, a looped top section 92 which loops around inwardly curved top 84 of base 72, and a vertical rear which extends adjacent to rear 82 of base 72. A vertically extending channel 96 having a generally U-shaped cross-section is formed between front and rear sections 90 and 94, respectively, of looped channel 88 for receiving the extension wand 60 and crevice tool 62 combination. A pair of tabs 98 extend inwardly from opposed sides of vertical channel for frictionally retaining the wand/crevice tool combination on base 72. Vertical channel 96 is formed with an inwardly curved top recess 100 for receiving a users fingers during the removal of the wand/crevice tool combination from its engagement with tabs 98.

Figures 2, 3, 4:
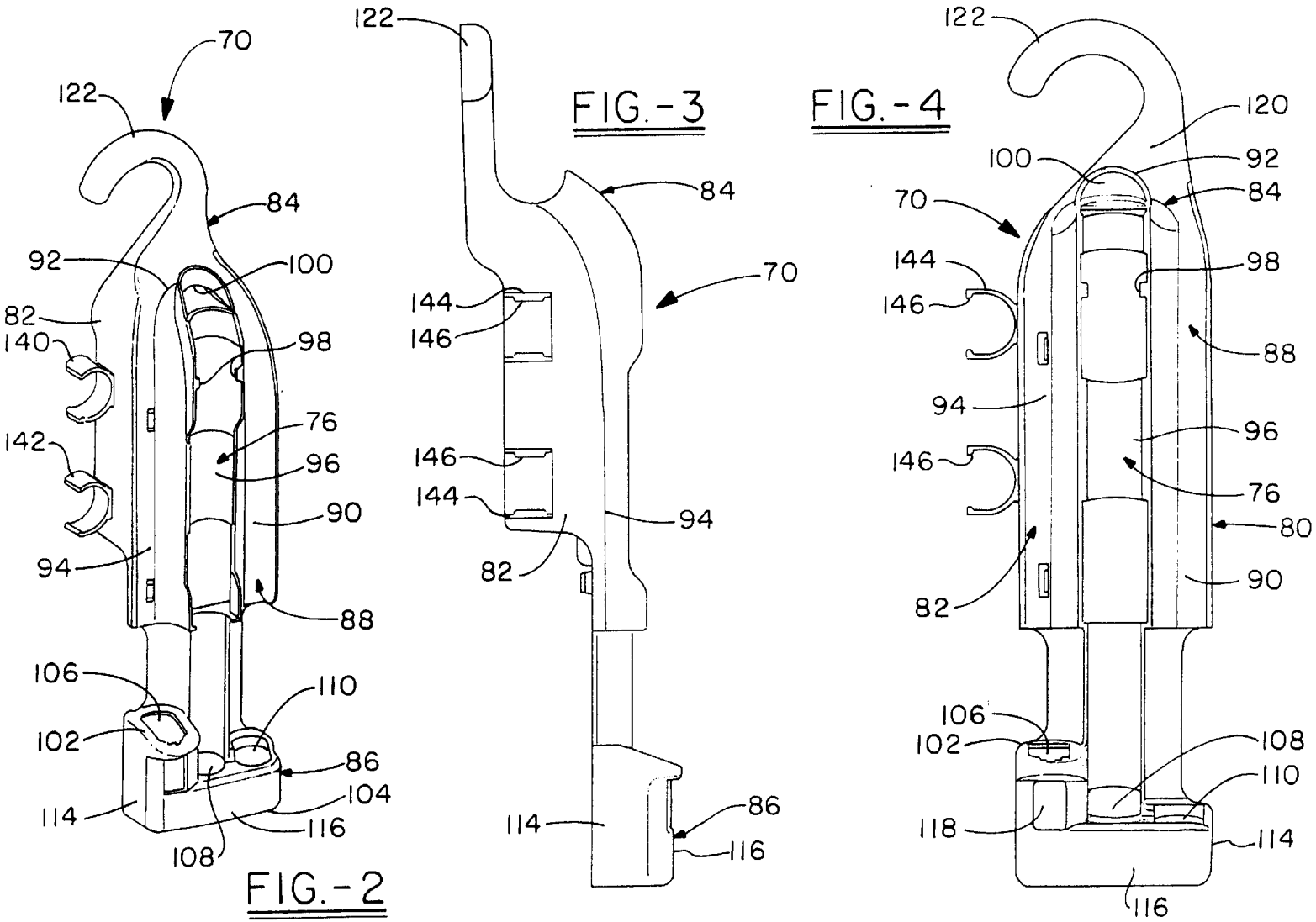
FIG. 2 is a perspective view of the hose and tool caddy of FIG. 1.
FIG. 3 is a rear view of the hose and tool caddy of FIG. 2.
FIG. 4 is a right side elevational view of the hose and tool caddy of FIG. 3.

Bottom shelf 86 is generally L-shaped and extends outwardly from the bottom of base 72 (FIGS. 2 and 4). Shelf 86 includes a raised rear section 102 and a lower front section 104. Rear section 102 is formed with a top opening 106 for receiving proximate end 50 of hose 52. Front section 104 is formed with a pair of circular holes 108 and 110 for receiving the end of extension wand 60 and distal end 54 of hose 52, respectively. Shelf 86 includes a front wall 112, a rear wall 114 and an outer sidewall 116 which is formed with a rectangular opening 118.

In the shown preferred embodiment of the invention, top 84 of base 72 curves inwardly (FIGS. 3 and 5) to follow the curved contour of rear housing 40 of upright vacuum cleaner 20. A generally triangular shaped side wall 120 (FIGS. 2 and 4) extends vertically upwardly from top 84 and tapers into a generally C-shaped hook 122. Hook 122 may be used as a handle for grasping and removing hose and tool caddy 70 from upright vacuum cleaner 20 and may be used to hang hose and tool caddy 70 on a closet bar, door knob or the like when hose and tool caddy 70 is in the removed position.

Base 72 includes a front wall 130 (FIG. 5) formed on front 80 thereof, and a rear wall 132 (FIG. 3) formed on rear 82 thereof. Front wall 130 extends outwardly to form an outer wall to front 90 of curved channel 88, and extends inwardly to form a lip 134 on inner surface 78 of base 72. Rear wall 122 extends inwardly from the edge of rear 94 of curved channel 88. Lip 134 and rear wall 132 curve inwardly along the edge of top 84 to form front and rear walls of hook 122. A pair of spacers 136 (FIGS. 5 and 6) are formed on inner surface 78 of base 72 for maintaining a spaced relationship between base 72 and the right side of rear housing 40. A pair of resilient C-clamps 140 and 142 (FIGS. 2 and 3) are formed integrally with and extend rearwardly from rear wall 132 for frictionally retaining dusting brush 56 and furniture nozzle 58, respectively. Each clamp 140 and 142 includes a pair of opposed outwardly extending nubs 144, and a pair of opposed ribs 146 which are positioned at the outer ends of C-clamps 140 and 142. Nubs 144 and ribs 146 contact the tubular ends of the accessory tools for frictionally retaining the tools within C-clamps 140 and 142, as shown in FIG. 1.

Figure 9:
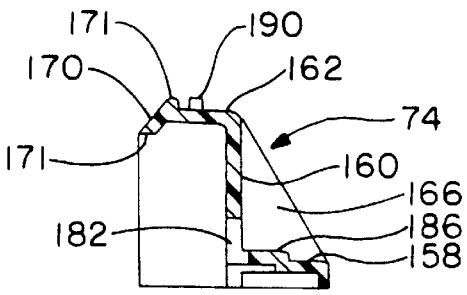
FIG. 9 is a sectional view taken along line 9—9, FIG. 8.
Figure 8:
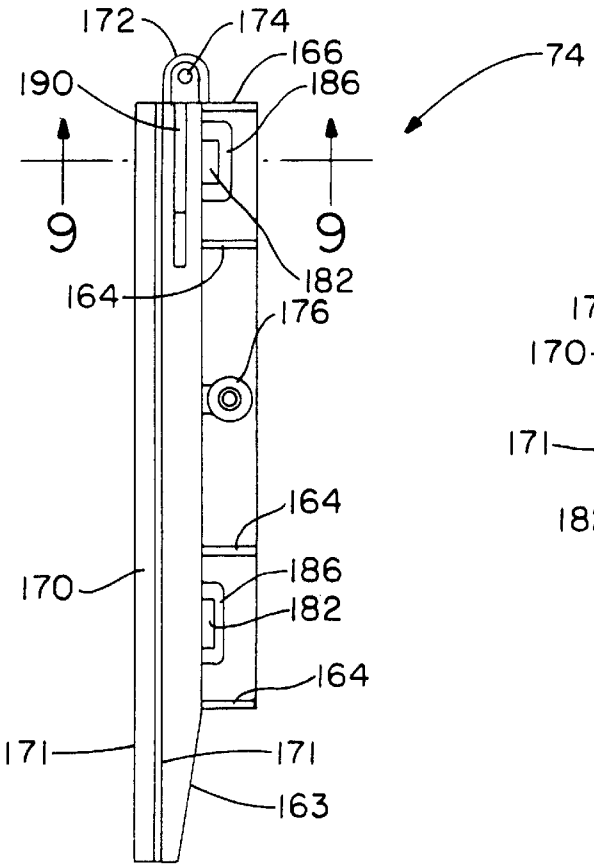
FIG. 8 is a right side elevational view of the guide member of FIG. 7.
Figure 7:
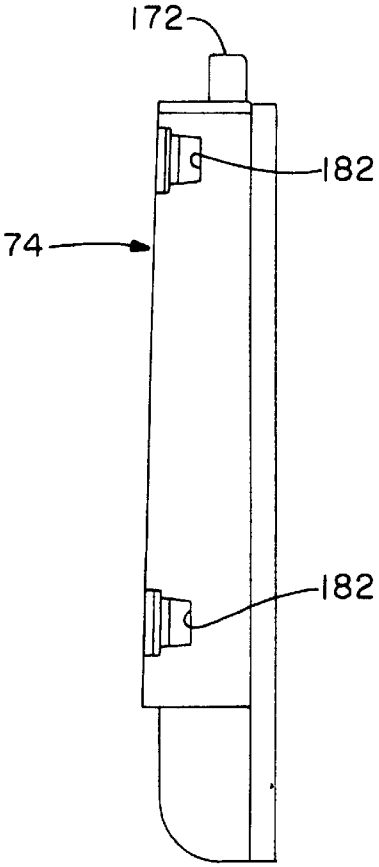
FIG. 7 is front elevational view of the guide member of FIG. 6.
Figure 11:
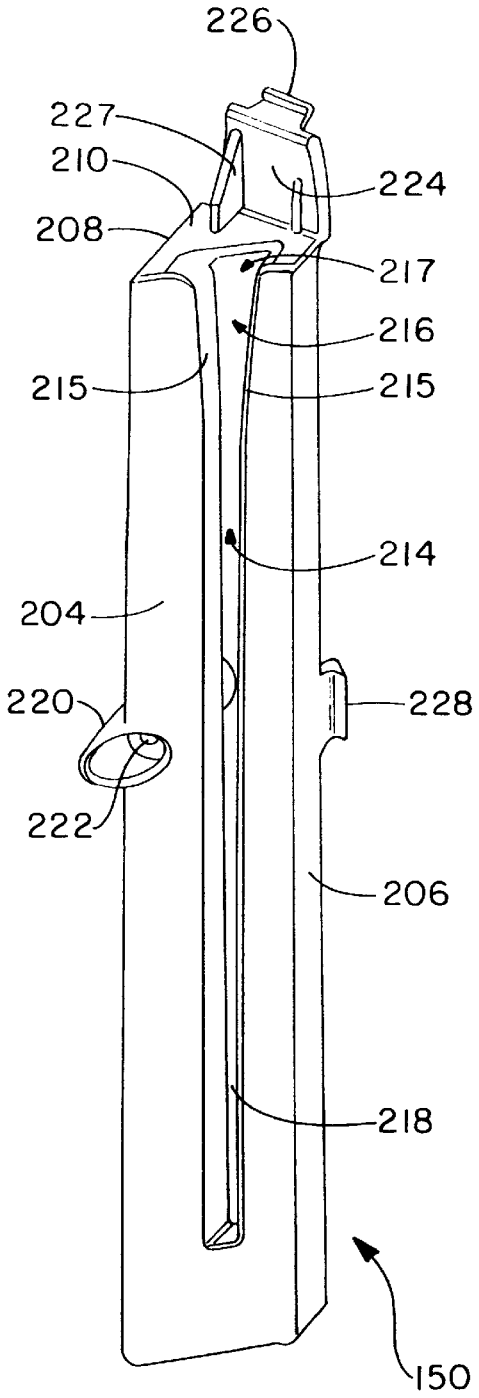
FIG. 11 is a perspective view of a track member which is received within the recessed area of the housing.
Figure 12:
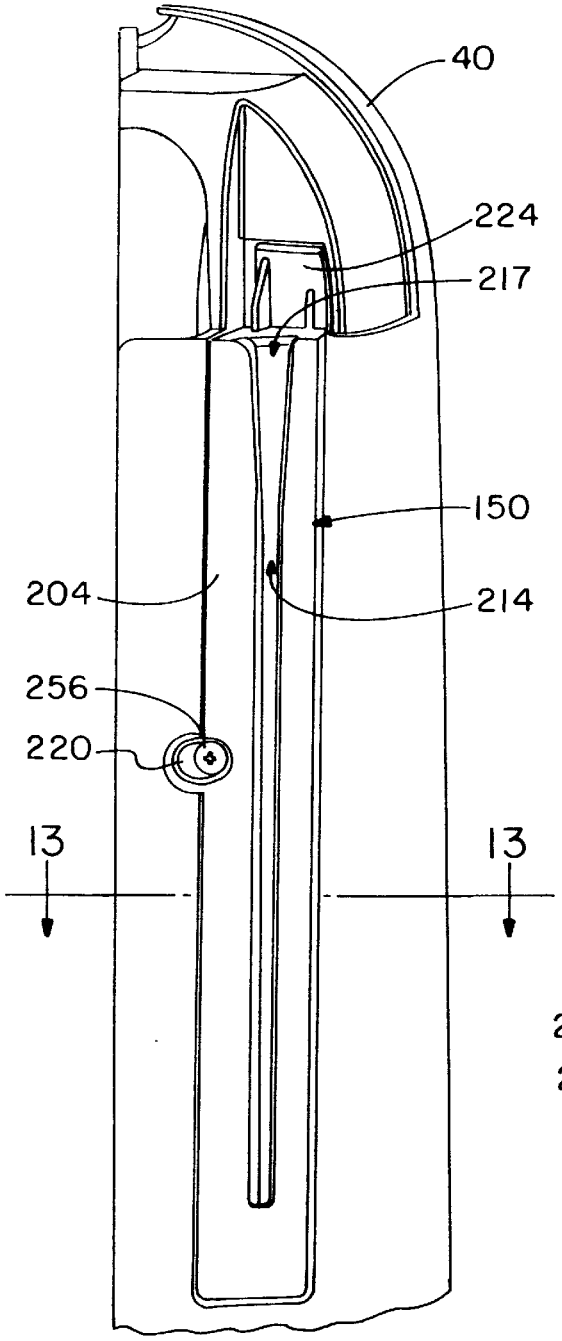
FIG. 12 is a fragmentary perspective view similar to FIG. 10 showing the track member assembled within the recessed area.
Figure 13:
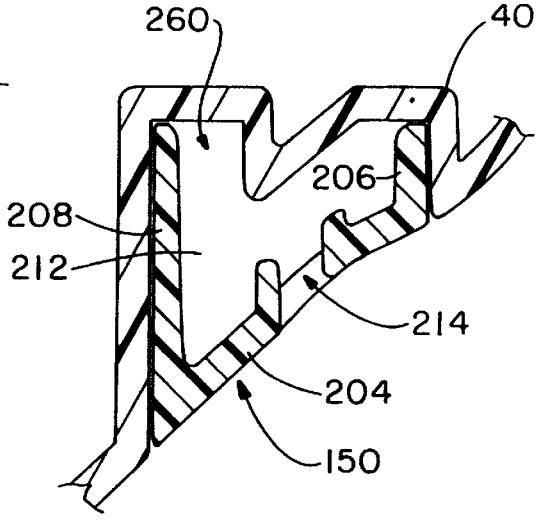
FIG. 13 is a fragmentary sectional view taken along line 13—13, FIG. 12.

In the preferred embodiment of the present invention, base 72 of hose and tool caddy 70 is retained on upright vacuum cleaner 20 by guide member 74 (FIGS. 6–9) which is slidably received within a track member 150 (FIGS. 11–13). Guide member 74 is attached to inner surface 78 of base 72 between rear wall 132 and a support wall 152 (FIG. 6) which extends inwardly from inner surface 78. Guide member 74 is formed with a first wall 158 (FIG. 9) which sits between rear wall 132 and support wall 152 and abuts inner surface 78, a second wall 160 which extends outwardly from first wall 158 and which is juxtaposed with support wall 152, and a third wall 162 which extends outwardly from second wall 160. First wall 158 and third wall 162 extend at a 90 degree angle to and in opposite directions from second wall 160. Second wall 160 tapers slightly at a bottom 163 (FIG. 8) thereof. A plurality of triangular fillets 164 extend between first wall 158 and second wall 160 to strengthen guide member 74, with the top fillet 164 forming a top wall 166 of guide member 74. A plurality of smaller fillets (not shown) may extend between second wall 160 and third wall 162 to further strengthen guide member 174. A connecting wall 170 is formed integrally with the outer end of third wall 162 and extends at approximately a 45 degree angle thereto. Connecting wall 170 is formed with opposed outer free side edges 171 (FIGS. 8 and 9).

A screw lug 172 (FIG. 8) extends upwardly from top wall 166 and is formed with a circular hole 174. A circular boss 176 extends outwardly from first wall 158 and is attached at the side thereof to second wall 160. Lug 172 and boss 176 align with a pair of bosses 178 and 180 (FIG. 6), respectively, of inner surface 78 of base 72 and receive a fastener such as a screw or the like for attaching guide member 74 to base 72. A pair of slotted openings 182 (FIG. 8) are formed in the corner between first wall 158 and second wall 160 of guide member 74 for receiving a pair of barbed tabs 184 which extend outwardly from inner surface 78 (FIG. 6) of base 72. Barbed tabs 184 snap-fit with a raised latching surface 186 which surrounds the portion of slotted openings 182 formed in first wall 158. Barbed tabs 184 cooperate with the fasteners of lug 172 and boss 176 to attach guide member 74 to base 72. A camming ramp 190 (FIG. 8) is formed on third wall 162 adjacent to connecting wall 170 for providing a snug fit between guide member 74 and track member 150, as described below in further detail.

Figure 10:
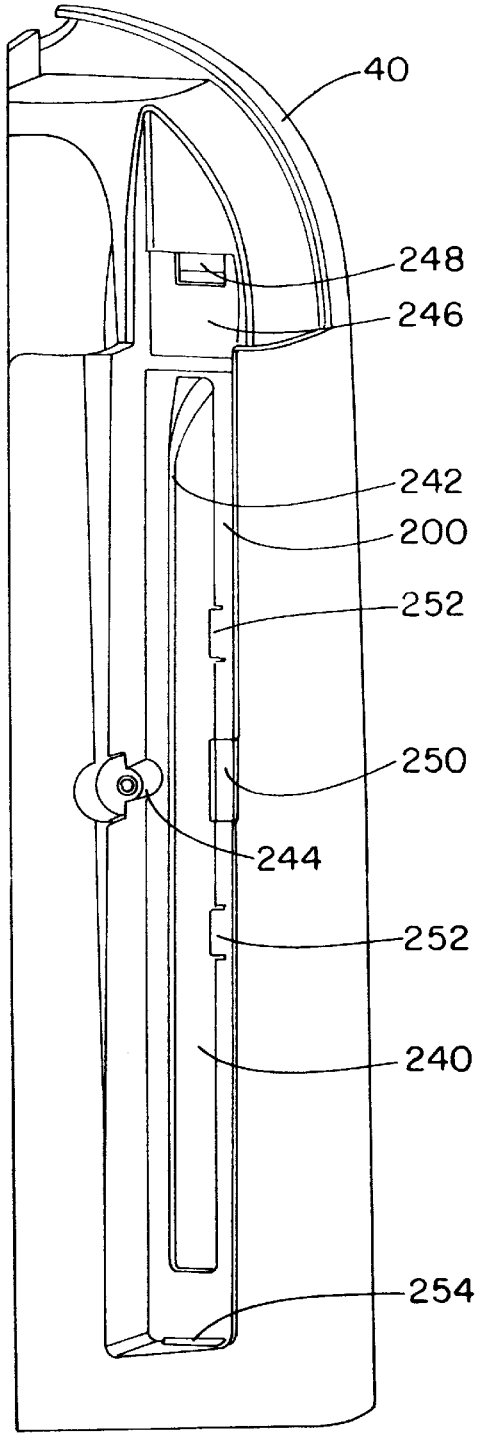
FIG. 10 is a fragmentary perspective view of the housing of the upright vacuum cleaner of FIG. 1 showing a recessed area formed in the left rear portion thereof.

In accordance with the preferred embodiment of the invention, housing 40 is formed with a vertically extending elongated recess 200 (FIG. 10) in the right rear corner thereof. Recess 200 receives track member 150 as shown in FIG. 12 and as described below. Track member 150 is shown in FIG. 11 and is an elongated one-piece member having a rear wall 204, a right side wall 206, a left side wall 208, a top wall 210 and a bottom wall 212. A slotted opening 214 is formed in rear wall 204 by a pair of spaced inwardly extending edge walls 215. Slotted opening 214 includes an upper section 216 which has an open top 217 and which tapers inwardly towards a lower section 218. Rear wall 204 is angled inwardly from left side wall 208 to right side wall 206 allowing track member 150 to conform to the angled contour of rear housing 40 (FIG. 12).

A countersunk screw boss 220 (FIG. 11) is formed on rear wall 204 adjacent to left side wall 208 and is formed with a circular hole 222. A retaining flange 224 extends upwardly from top wall 210 of track member 150 and includes a barbed tab 226 extending inwardly therefrom. A fillet 227 extends between top wall 210 and retaining flange 224. A second barbed tab 228 extends outwardly from right side wall 206. A tab (not shown) extends downwardly from bottom wall 212 to hold the bottom of track member 150 within recess 200, as described below.

Rear housing 40 is formed with an outwardly extending elongated cam 240 (FIG. 10) positioned within recess 200. Cam 240 is generally triangular in shape with the outer edge thereof forming a camming surface 242. A boss 244 is formed within recess 200 and is countersunk within rear housing 40 for receiving boss 220 of track member 150. An indented area 246 is formed in rear housing 40 which is slightly deeper then recess 200. A rectangular opening 248 is formed in rear housing 40 within indented area 246. A second rectangular opening 250 is formed in rear housing 40 adjacent the right side wall of recess 200. A pair of posts 252 extend outwardly from within recess 200 and are positioned on either side of second rectangular opening 250. A slotted opening 254 is formed in rear housing at the bottom of recess 200.

Track member 150 is assembled within recess 200 of rear housing 40 by inserting the bottom tab of track member 150 within bottom slotted opening 254. Right wall 206 extends between the posts 252 and the right sidewall of recess 200. Barbed tab 228 of track member 150 is received within opening 250 and snap-fits therein. Retaining flange 224 is positioned within indented area 246 and barbed tab 226 of retaining flange 224 snap-fits within opening 248. A fastener, such a screw 256, is inserted within hole 222 of boss 220 and engages boss 244 of rear housing 40. With retaining flange 224 sitting within indented area 246, upper handle 46 of upright vacuum cleaner 20 is assembled to rear housing 40 to trap retaining flange in position. Upper handle 46, barbed tabs 226 and 228, the bottom post and screw 256 all cooperate to retain track member 150 within recess 200. Track member 150 encloses recess 200 to form an inner chamber 260.

With track member 150 attached to rear housing 40 and guide member 74 attached to base 72, hose and tool caddy 70 may be removably mounted on upright vacuum cleaner 20. Tool caddy is grasped by top hook 122 and lifted above rear housing 40 until connecting wall 170 aligns vertically with top opening 217 of upper section 216 of slotted opening 214. Third wall 162 of guide member 74 slides within slotted opening 214 with outer edges 171 of connecting wall 170 being held against the inner surface of rear wall 204 within chamber 260. As connecting wall 170 is inserted within chamber 260, the connecting wall will cam against camming surface 242 of cam 240. As connecting wall 170 approaches the bottom of slotted opening 214, camming ramp 190 contacts the left edge wall 215. The camming ramp pushes guide member 74 and thus hose and tool caddy 70 outwardly. This outward force causes connecting wall 170 to abut the inner surface of edge wall 215 creating a snug fit between guide member 74 and track member 150. Spacers 136 abut the right side wall of rear housing 40 to maintain an equally spaced distance between hose and tool caddy 70 and rear housing 40, and to prevent twisting of the tool caddy relative to the rear housing.

Hose and tool caddy 70 may be easily removed from upright vacuum cleaner 20 by merely grasping hook 122 and applying an upward vertical force thereto. Guide member 74 will slide within track member 150 until the guide member disengages the track member and clears top opening 217. Hose and tool caddy 70 may be hung on a closet bar, door knob or the like for storage when the tool caddy is in the removed position.

It is understood that although in the preferred embodiment hose and tool caddy 70 is shown attached to an upright having a bag and a hard bag housing closed by a bag door, the vacuum cleaner 20 could be a bagless cleaner or a soft bag cleaner without affecting the concept of the invention. It is also understood that slotted opening 214 may be formed directly in rear housing 40, and that guide member 74 may be molded integrally with base 72 without affecting the concept of the invention.

Accordingly, the improved removable hose and tool caddy for a vacuum cleaner is simplified, provides an effective, inexpensive, and efficient device which achieves all of the enumerated objectives. While there has been shown and described herein a preferred embodiment of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. In combination, an upright vacuum cleaner and an accessory caddy removably mounted to the upright vacuum cleaner for receiving vacuum cleaner accessories, said upright vacuum cleaner having a bag housing and an upper handle portion, said bag housing being formed with a vertically extending side wall and a top wall, said accessory caddy including:

a base;

a connector for removably mounting said base on the side wall of the bag housing;

an accessory retainer formed on the base for storing the vacuum cleaner accessories; and whereby the accessory caddy and the vacuum cleaner accessories stored thereon may be slidably removed from the upright vacuum cleaner by merely applying a force to said base.

2. The combination as defined in claim 1 in which the base includes an inner surface, an outer surface, a top, a front and a rear.

3. The combination as defined in claim 2 in which the inner surface of the base extends adjacent the vertically extending side wall of the bag housing.

4. The combination as defined in claim 2 in which a handle extends upwardly from the top of the base.

5. The combination as defined in claim 2 in which the accessory retainer includes a generally U-shaped channel formed in the outer surface of the base for receiving the hose.

6. The combination as defined in claim 2 in which the accessory retainer includes a resilient clamp which extends outwardly from the rear of the base.

7. The combination as defined in claim 6 in which the clamp is generally C-shaped for releasably engaging a tubular end of the tools.

8. In combination, an upright vacuum cleaner having a housing and a removable caddy which may be mounted on and removed from the housing for storing vacuum cleaner accessories on the upright vacuum cleaner, said removable caddy including:

a base which removably mounts to the housing;

a connector on the base for removably mounting the base on the housing;

an accessory retainer formed on the base for storing the vacuum cleaner accessories; and whereby the caddy and the vacuum cleaner accessories stored thereon may be slidably removed from the upright vacuum cleaner by merely applying a force to said base.

9. The combination defined in claim 8 in which the housing includes a track member.

10. The combination defined in claim 9 in which the connector includes a guide member which is slidably received within the track member to removably mount the tool caddy to the housing.

11. The combination defined in claim 10 in which the track member extends vertically on the vacuum cleaner housing; in which the guide member is formed vertically on the base of the caddy; and in which the track member and guide member cooperate to vertically mount the caddy to the vacuum cleaner housing.

12. The combination defined in claim 10 in which the track member is formed with a slotted opening.

13. The combination defined in claim 12 in which the guide member is formed with a retaining flange which is slidably received within the slotted opening of the track member.

14. The combination defined in claim 13 in which a camming surface is formed within the slotted opening of the track member, and in which the guide member cams against the camming surface as the guide member is slidably received within the track member.

15. The combination defined in claim 14 in which the vacuum cleaner housing is formed with a recess and in which the track member is positioned within said recess.

16. The combination defined in claim 8 in which the accessory retainer includes a resilient clamp for releasably retaining vacuum cleaner accessories including at least one of a dusting brush and a furniture nozzle.

17. The combination defined in claim 8 in which the accessory retainer includes a vertically extending channel formed in the base for releasably retaining vacuum cleaner accessories including at least one of an extension wand and a crevice tool.

18. The combination defined in claim 8 in which the accessory retainer includes a looped channel having a generally U-shaped cross-section for releasably retaining a vacuum cleaner accessory hose.

19. The combination defined in claim 8 further including a handle extending from the base.

20. The combination defined in claim 19 in which the handle includes a hook for hanging the tool caddy when said tool caddy is removed from the housing.

21. In combination, an upright vacuum cleaner having a housing assembly which includes a housing formed with a dirt collecting receptacle and a handle extending upwardly from the housing, and a caddy removably mounted on the housing for storing vacuum cleaner accessories, said caddy including:

a base which removably mounts to the housing a connector on the base for removably mounting the base on the housing;

an accessory retainer formed on the base for storing the vacuum cleaner accessories on the caddy; and whereby the caddy and the vacuum cleaner accessories stored thereon may be slidably removed from the upright vacuum cleaner by merely applying a force to said base.

22. In combination, an upright cleaning appliance having a housing assembly which includes a housing for supporting a receptacle and a handle extending upwardly from the housing, and a caddy removably mounted on the housing for storing cleaning accessories, said caddy including:

a base which removably mounts to the housing;

a connector on the base for removably mounting the base on the housing;

an accesory retainer formed on the base for storing the cleaning accessories on the caddy; and whereby the caddy and the cleaning accessories stored thereon may be removed from the upright cleaning appliance by merely applying a force to said base.

23. The combination defined in claim 22 in which the housing includes a track member.

24. The combination defined in claim 23 in which the connector includes a guide member which is slidably received within the track member to removably mount the tool caddy to the housing.

25. The combination defined in claim 24 in which the track member extends vertically on the vacuum cleaner housing; in which the guide member is formed vertically on the base of the caddy; and in which the track member and guide member cooperate to vertically mount the caddy to the vacuum cleaner housing.

26. The combination defined in claim 24 in which the track member is formed with a slotted opening.

27. The combination defined in claim 26 in which the guide member is formed with a retaining flange which is slidably received within the slotted opening of the track member.

28. The combination defined in claim 27 in which a camming surface is formed within the slotted opening of the track member, and in which the guide member cams against the camming surface as the guide member is slidably received within the track member.

29. The combination defined in claim 28 in which the vacuum cleaner housing is formed with a recess and in which the track member is positioned within said recess.

30. The combination defined in claim 22 in which the accessory retainer includes a resilient clamp for releasably retaining the cleaning accessories, said cleaning accessories including at least one of a dusting brush and a furniture nozzle.

31. The combination defined in claim 22 in which the accessory retainer includes a vertically extending channel formed in the base for releasably retaining the cleaning accessories, said cleaning accessories including at least one of an extension wand and a crevice tool.

32. The combination defined in claim 22 in which the accessory retainer includes a looped channel having a generally U-shaped cross-section for releasably retaining an accessory hose.

33. The combination defined in claim 22 further including a handle extending from the base.

34. The combination defined in claim 33 in which the handle includes a hook for hanging the tool caddy when said tool caddy is removed from the housing.

35. In combination, an upright vacuum cleaner and an accessory caddy removably mounted to the upright vacuum cleaner for receiving vacuum cleaner accessories, said upright vacuum cleaner having a housing and an upper handle portion, said housing being formed with a vertically extending side wall and a top wall, said accessory caddy including:

a base having an inner surface, an outer surface, a top, a front and a rear;

a handle extending upwardly from the top of the base;

a connector for removably mounting said base on the side wall of the housing; and an accessory retainer formed on the base for storing the vacuum cleaner accessories.

36. In combination, an upright vacuum cleaner having a housing and a removable caddy which may be mounted on and removed from the housing for storing vacuum cleaner accessories on the upright vacuum cleaner, said removable caddy including:

a base which removably mounts to the housing;

a connector on the base for removably mounting the base on the housing;

an accessory retainer formed on the base for storing the vacuum cleaner accessories; and in which the housing includes a track member.

37. In combination, an upright vacuum cleaner having a housing and a removable caddy which may be mounted on and removed from the housing for storing vacuum cleaner accessories on the upright vacuum cleaner, said removable caddy including:

a base which removably mounts to the housing;

a connector on the base for removably mounting the base on the housing;

an accessory retainer formed on the base for storing the vacuum cleaner accessories; and a handle extending from the base.

38. In combination, an upright cleaning appliance having a housing assembly which includes a housing for supporting a receptacle and a handle extending upwardly from the housing, and a caddy removably mounted on the housing for storing cleaning accessories, said caddy including:

a base which removably mounts to the housing;

a connector on the base for removably mounting the base on the housing;

an accessory retainer formed on the base for storing the cleaning accessories on the caddy; and in which the housing includes a track member.

39. In combination, an upright cleaning appliance having a housing assembly which includes a housing for supporting a receptacle and a handle extending upwardly from the housing, and a caddy removably mounted on the housing for storing cleaning accessories, said caddy including:

a base which removably mounts to the housing;

a connector on the base for removably mounting the base on the housing;

an accessory retainer formed on the base for storing the cleaning accessories on the caddy; and a handle extending from the base.

* * * * *